US005771606A

United States Patent [19]

Litchfield et al.

[11] Patent Number: 5,771,606

[45] Date of Patent: Jun. 30, 1998

[54] SUPPORT AND CUSHIONING SYSTEM FOR AN ARTICLE OF FOOTWEAR

[75] Inventors: Paul E. Litchfield, Westborough; Matthew J. Montross, Quincy; Steven F. Smith, Taunton; J. Spencer White, N. Easton; Alexander W. Jessiman, Scituate, all of Mass.

[73] Assignee: Reebok International Ltd., Stoughton, Mass.

[21] Appl. No.: 697,895

[22] Filed: Sep. 3, 1996

Related U.S. Application Data

[63] Continuation-in-part of Ser. No. 599,100, Feb. 9, 1996, abandoned, which is a continuation of Ser. No. 284,646, filed as PCT/US94/00895, Jan. 26, 1994, abandoned.

[51] Int. Cl.[6] ..... A43B 13/18; A43B 13/20; A43B 19/00

[52] U.S. Cl. ..... 36/29; 36/28; 36/71

[58] Field of Search ..... 36/28, 29, 31, 36/35 B, 71, 93, 153

[56] References Cited

U.S. PATENT DOCUMENTS

| | | | |
|---|---|---|---|
| Re. 34,102 | 10/1992 | Cole et al. . | |
| 1,069,001 | 7/1913 | Guy . | |
| 1,605,985 | 11/1926 | Rasmussen . | |
| 2,080,499 | 5/1937 | Nathansohn . | |
| 2,266,476 | 12/1941 | Riess . | |
| 3,120,712 | 2/1964 | Menken . | |
| 3,225,463 | 12/1965 | Burnham . | |
| 3,469,576 | 9/1969 | Smith et al. . | |
| 4,100,686 | 7/1978 | Sgarlato et al. . | |
| 4,219,945 | 9/1980 | Rudy . | |
| 4,312,140 | 1/1982 | Reber . | |
| 4,358,902 | 11/1982 | Cole et al. | 36/29 |
| 4,446,634 | 5/1984 | Johnson et al. . | |
| 4,458,430 | 7/1984 | Peterson . | |
| 4,577,417 | 3/1986 | Cole . | |
| 4,799,319 | 1/1989 | Zellweger . | |
| 4,845,861 | 7/1989 | Moumdjian . | |
| 4,856,208 | 8/1989 | Zaccaro | 36/29 |
| 4,936,030 | 6/1990 | Rennex | 36/29 |
| 5,025,575 | 6/1991 | Lakic . | |
| 5,131,174 | 7/1992 | Drew et al. | 36/29 |

(List continued on next page.)

FOREIGN PATENT DOCUMENTS

| | | | |
|---|---|---|---|
| 720257 | 2/1932 | France . | |
| 2614510 | 11/1988 | France | 36/29 |
| 2663208 | 12/1991 | France . | |
| 820869 | 11/1951 | Germany . | |
| 28 00 359 | 7/1979 | Germany . | |
| 338266 | 11/1930 | United Kingdom . | |
| 2039717 | 8/1980 | United Kingdom . | |
| 2114425 | 8/1983 | United Kingdom | 36/28 |
| WO 91/16831 | 11/1991 | WIPO . | |
| WO 93/12685 | 7/1993 | WIPO . | |
| WO 93/14659 | 8/1993 | WIPO . | |
| WO 95/20332 | 8/1995 | WIPO . | |

*Primary Examiner*—Paul T. Sewell
*Assistant Examiner*—Anthony Stashick
*Attorney, Agent, or Firm*—Sterne, Kessler, Goldstein & Fox P.L.L.C.

[57] ABSTRACT

A support and cushioning system for an article of footwear. The system includes a resilient insert disposed between a midsole and an outsole of a shoe. The resilient insert includes several chambers disposed in a heel portion of the resilient insert. These chambers are fluidly interconnected to each other via periphery passages. The resilient insert also includes several chambers disposed in a forefoot portion of the resilient insert. These chambers are also fluidly interconnected to each other. A connecting passage connects the chambers in the heel portion and the chambers in the forefoot portion of the resilient insert. A bladder having a fluidly interconnected heel chamber and forefoot chamber is also inserted above the midsole to provided added cushioning to the wearer. In one embodiment, the resilient insert contains air at ambient pressure and the bladder contains air at slightly above ambient pressure.

28 Claims, 7 Drawing Sheets

U.S. PATENT DOCUMENTS

| | | | |
|---|---|---|---|
| 5,179,792 | 1/1993 | Brantingham . | |
| 5,195,257 | 3/1993 | Holcomb et al. | 36/71 |
| 5,230,249 | 7/1993 | Sasaki et al. | 36/29 |
| 5,313,717 | 5/1994 | Allen et al. . | |
| 5,335,382 | 8/1994 | Huang . | |
| 5,343,639 | 9/1994 | Kilgore et al. | 36/29 |
| 5,353,525 | 10/1994 | Grim | 36/29 |
| 5,375,346 | 12/1994 | Cole et al. . | |
| 5,406,719 | 4/1995 | Potter . | |
| 5,416,986 | 5/1995 | Cole et al. | 36/29 |
| 5,545,463 | 8/1996 | Schmidt et al. | 36/35 B |
| 5,701,687 | 12/1997 | Schmidt et al. | 36/29 |

1312
1304
1312
1314
1002
606
706
706
102
702
702
604

1310
14
1308
1304
1306
1302
1314
1002
606
102
604
14

SUPPORT AND CUSHIONING SYSTEM FOR AN ARTICLE OF FOOTWEAR

CROSS-REFERENCE TO RELATED APPLICATION

This is a continuation-in-part of U.S. application Ser. No. 08/599,100, filed Feb. 9, 1996, now abandoned, which is a continuation of U.S. application Ser. No. 08/284,646, filed Oct. 14, 1994, now abandoned, which is the U.S. National Phase Application of International Application No. PCT/US94/00895, filed Jan. 26, 1994.

BACKGROUND OF THE INVENTION

1. Field of the Invention

This invention relates generally to footwear, and more particularly to an article of footwear having a system for providing cushioning and support for the comfort of the wearer.

2. Related Art

One of the problems associated with shoes has always been striking a balance between support and cushioning. Throughout the course of an average day, the feet and legs of an individual are subjected to substantial impact forces. Running, jumping, walking and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. An athlete's stride is partly the result of energy which is stored in the flexible tissues of the foot. For example, during a typical walking or running stride, the achilles tendon and the arch stretch and contract, storing energy in the tendons and ligaments. When the restrictive pressure on these elements is released, the stored energy is also released, thereby reducing the burden which must be assumed by the muscles.

Although the human foot possesses natural cushioning and rebounding characteristics, the foot alone is incapable of effectively overcoming many of the forces encountered during athletic activity. Unless an individual is wearing shoes which provide proper cushioning and support, the soreness and fatigue associated with athletic activity is more acute, and its onset accelerated. This results in discomfort for the wearer which diminishes the incentive for further athletic activity. Equally important, inadequately cushioned footwear can lead to injuries such as blisters, muscle, tendon and ligament damage, and bone stress fractures. Improper footwear can also lead to other ailments, including back pain.

Proper footwear should complement the natural functionality of the foot, in part by incorporating a sole (typically, an outsole, midsole and insole) which absorbs shocks. However, the sole should also possess enough resiliency to prevent the sole from being "mushy" or "collapsing," thereby unduly draining the energy of the wearer.

In light of the above, numerous attempts have been made over the years to incorporate into a shoe means for providing improved cushioning and resiliency to the shoe. For example, attempts have been made to enhance the natural elasticity and energy return of the foot by providing shoes with soles which store energy during compression and return energy during expansion. These attempts have included using compounds such as ethylene vinyl acetate (EVA) or polyurethane (PU) to form midsoles. However, foams such as EVA tend to break down over time, thereby losing their resiliency.

Another concept practiced in the footwear industry to improve cushioning and energy return has been the use of fluid-filled devices within shoes. These devices attempt to enhance cushioning and energy return by transferring a pressurized fluid between the heel and forefoot areas of a shoe. The basic concept of these devices is to have cushions containing pressurized fluid disposed adjacent the heel and forefoot areas of a shoe. The overriding problem of these devices is that the cushioning means are inflated with a pressurized gas which is forced into the cushioning means, usually through a valve accessible from the exterior of the shoe.

There are several difficulties associated with using a pressurized fluid within a cushioning device. Most notably, it may be inconvenient and tedious to constantly adjust the pressure or introduce a fluid to the cushioning device. Moreover, it is difficult to provide a consistent pressure within the device thereby giving a consistent performance of the shoes. In addition, a cushioning device which is capable of holding pressurized gas is comparatively expensive to manufacture. Further, pressurized gas tends to escape from such a cushioning device, requiring the introduction of additional gas. Finally, a valve which is visible to the exterior of the shoe negatively affects the aesthetics of the shoe, and increases the probability of the valve being damaged when the shoe is worn.

A cushioning device which, when unloaded contains air at ambient pressure provides several benefits over similar devices containing pressurized fluid. For example, generally a cushioning device which contains air at ambient pressure will not leak and lose air, because there is no pressure gradient in the resting state. The problem with many of these cushioning devices is that they are either too hard or too soft. A resilient member that is too hard may provide adequate support when exerting pressure on the member, such as when running. However, the resilient member will likely feel uncomfortable to the wearer when no force is exerted on the member, such as when standing. A resilient member that is too soft may feel cushy and comfortable to a wearer when no force is exerted on the member, such as when standing or during casual walking. However, the member will likely not provide the necessary support when force is exerted on the member, such as when running. Further, a resilient member that is too soft may actually drain energy from the wearer.

Accordingly, what is needed is a shoe which incorporates a cushioning system including a means to provide resilient support to the wearer during fast walking and running, and to provide adequate cushioning to the wearer during standing and casual walking.

SUMMARY OF THE INVENTION

To achieve the foregoing and other objects, and in accordance with the purposes of the present invention as embodied and broadly described herein, the article of footwear of the present invention comprises a sole and a resilient support and cushioning system. The system of the present invention includes a resilient insert member and a bladder disposed within an article of footwear.

In one embodiment, the resilient insert includes a plurality of heel chambers, a plurality of forefoot chambers and a central connecting passage fluidly interconnecting the chambers. The resilient insert is preferably blow molded from an elastomeric material, and may contain air at ambient pressure or slightly above ambient pressure. The resilient insert is placed between an outsole and a midsole of the article of footwear.

In one embodiment, the central connecting passage contains an impedance means to restrict the flow of air between the heel chambers and the forefoot chambers. Thus, during heel strike, the air is prevented from rushing out of the heel chambers all at once. Thus, the air in the heel chambers provides support and cushioning to the wearer's foot during heel strike.

The bladder of the present invention includes a heel chamber, a forefoot chamber and at least one connecting passage fluidly interconnecting the two chambers. The bladder is disposed above the midsole of the article of footwear, and provides added cushioning to the wearer's foot. In one embodiment, the bladder is thermoformed from two sheets of resilient, non-permeable elastomeric material such that the bladder contains air at slightly above ambient pressure.

In use, the bladder provides cushioning to the wearer's foot while standing or during casual walking. The resilient insert provides added support and cushioning to the wearer's foot during fast walking and running. In an alternate embodiment, for example, for use as a high performance shoe, the article of footwear may contain only the resilient insert disposed between the midsole and outsole. In another alternate embodiment, for example, for use as a casual shoe, the article of footwear may contain only the bladder disposed above the midsole.

When stationary, the foot of a wearer is cushioned by the bladder. When the wearer begins a stride, the heel of the wearer's foot typically impacts the ground first. At this time, the weight of the wearer applies downward pressure on the heel portion of the resilient insert, causing the heel chambers to be forced downwardly.

The heel chambers of the resilient insert are connected via periphery passages. These passages essentially divide the heel portion into a medial region and a lateral region so that the resilient insert is designed geometrically to help compensate for the problem of pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, and then moves to the medial side of the forefoot area during "toe-off." The configuration of the passages between the heel chambers ensures that the air flow within the resilient insert complements such a gait cycle.

Thus, the downward pressure resulting from heel strike causes air within the resilient insert to flow from the medial region into the lateral region. Thus, the medial region is cushioned first to prevent the wearer's foot from rolling inwardly. Further compression of the heel portion causes the air in the lateral region to be forced forwardly, through the central connecting passage and into the forefoot portion of the resilient insert.

The flow of air into the forefoot portion causes the forefoot chambers to expand, which slightly raises the forefoot or metatarsal area of the foot. When the forefoot of the wearer is placed upon the ground, the expanded forefoot chambers help cushion the corresponding impact forces. As the weight of the wearer is applied to the forefoot, the downward pressure caused by the impact forces causes the forefoot chambers to compress, forcing the air therein to be thrust rearwardly through the central connecting passage into the heel portion.

After "toe-off," no downward pressure is being applied to the article of footwear, so the air within the resilient insert should return to its normal state. Upon the next heel strike, the process is repeated.

In light of the foregoing, it will be understood that the system of the present invention provides a variable, non-static cushioning, in that the flow of air within the bladder and the resilient insert complements the natural biodynamics of an individual's gait.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

Another cushioning device is described in U.S. patent application Ser. No. 08/599,100, filed Feb. 9, 1996, for a "Resilient Insert For An Article of Footwear," now pending, the disclosure of which is incorporated herein by reference, and which is a file wrapper continuation of U.S. patent application Ser. No. 08/284,646, filed Aug. 11, 1994, now abandoned, which claims priority under 35 U.S.C. § 119 to International Application Number PCT/US94/00895, filed Jan. 26, 1994.

Referring now to FIGS. 1–5, a resilient insert 102 is shown. Resilient insert 102 provides continuously modifying cushioning to an article of footwear, such that a wearer's stride forces air within resilient insert 102 to move in a complementary manner with respect to the stride.

Figure 1:
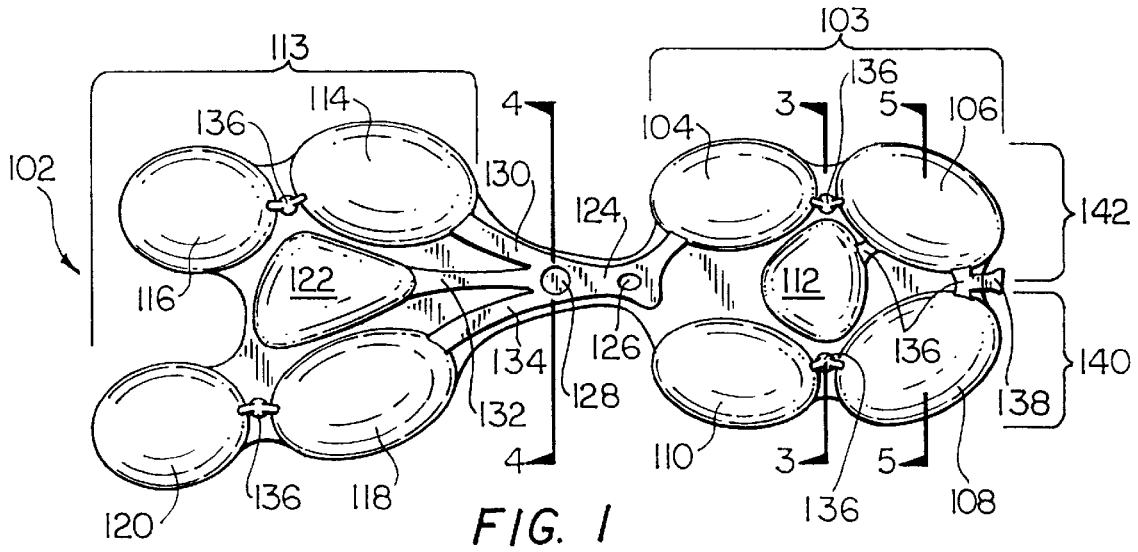
FIG. 1 is a top plan view of a resilient insert in accordance with the present invention.
Figure 2:
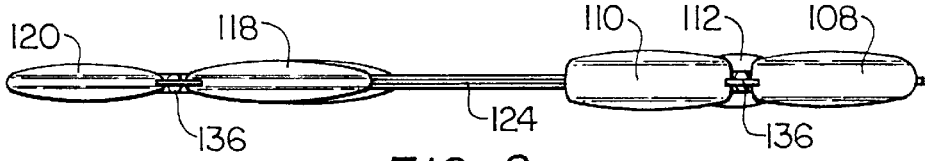
FIG. 2 is a medial side view of the resilient insert of FIG. 1.

FIG. 1 is a top plan view of resilient insert 102 in accordance with the present invention. However, FIG. 1 may in fact be either a top or bottom plan view, as the top and bottom of resilient insert 102 are substantially the same. FIG. 2 is a medial side view of resilient insert 102.

Resilient insert 102 is a three-dimensional structure formed of a suitably resilient material so as to allow resilient insert 102 to compress and expand while resisting breakdown. Preferably, resilient insert 102 may be formed from a thermoplastic elastomer or a thermoplastic olefin. Suitable materials used to form resilient insert 102 may include various ranges of the following physical properties:

| | Preferred Lower Limit | Preferred Upper Limit |
|---|---|---|
| Density (Specific Gravity in g/cm$^3$) | 0.80 | 1.35 |
| Modulus @ 300% Elongation (psi) | 1,000 | 6,500 |
| Permanent Set @ 200% Strain (%) | 0 | 55 |
| Compression Set 22 hr/23° C. | 0 | 45 |
| Hardness Shore A | 70 | — |
| Shore D | 0 | 55 |
| Tear Strength (KN/m) | 60 | 600 |
| Permanent Set at Break (%) | 0 | 600 |

Many materials within the class of Thermoplastic Elastomers (TPEs) or Thermoplastic Olefins (TPOs) can be utilized to provide the above physical characteristics. Thermoplastic Vulcanates (such as SARLINK from PSM, SANTAPRENE from Monsanto and KRATON from Shell) are possible materials due to physical characteristics, processing and price. Further, Thermoplastic Urethanes (TPU's), including a TPU available from Dow Chemical Company under the tradename PELLETHANE (Stock No. 2355-95AE), a TPU available from B. F. Goodrich under the tradename ESTANE and a TPU available from BASF under the tradename ELASTOLLAN provide the physical characteristics described above. Additionally, resilient insert 102 can be formed from natural rubber compounds. However, these natural rubber compounds currently cannot be blow molded as described below.

The preferred method of manufacturing resilient insert 102 is via extrusion blow molding. It will be appreciated by those skilled in the art that the blow molding process is relatively simple and inexpensive. Further, each element of resilient insert 102 of the present invention is created during the same preferred molding process. This results in a unitary, "one-piece" resilient insert 102, wherein all the unique elements of resilient insert 102 discussed herein are accomplished using the same mold. Resilient insert 102 can be extrusion blow molded to create a unitary, "one-piece" component, by any one of the following extrusion blow molding techniques: needle or pin blow molding with subsequent sealing, air entrapped blow molding, pillow blow molding or frame blow molding. These blow molding techniques are known to those skilled in the relevant art.

Alternatively, other types of blow molding, such as injection blow molding and stretch blow molding may be used to form resilient insert 102. Further, other manufacturing methods can be used to form resilient insert 102, such as thermoforming and sealing, or vacuum forming and sealing.

Resilient insert 102 is a hollow structure preferably filled with ambient air. In one embodiment, resilient insert 102 is impermeable to air; i.e., hermetically sealed, such that it is not possible for the ambient air disposed therein to escape upon application of force to resilient insert 102. Naturally, diffusion may occur in and out of resilient insert 102. The unloaded pressure within resilient insert 102 is preferably equal to ambient pressure. Accordingly, resilient insert 102 retains its cushioning properties throughout the life of the article of footwear in which it is incorporated. If resilient insert 102 is formed by air entrapment extrusion blow molding, the air inside resilient insert 102 may be slightly higher than ambient pressure (e.g., between 1–5 psi above ambient pressure).

As can be seen with reference to FIG. 1, resilient insert 102 is preferably a unitary member comprising three distinct components: a heel portion 103, a forefoot portion 113, and a central connecting passage 124. Heel portion 103 is generally shaped to conform to the outline of the bottom of an individual's heel, and is disposed beneath the heel of a wearer when resilient insert 102 is incorporated within a shoe. In one embodiment, as shown in FIG. 1, heel portion 103 includes a plurality of peripheral heel chambers 104, 106, 108, 110 and a central heel air chamber 112.

Disposed opposite heel portion 103 is forefoot portion 113. Forefoot portion 113 is generally shaped to conform to the forefoot or metatarsal area of a foot, and is disposed beneath a portion of the forefoot of a wearer when incorporated within a shoe. In one embodiment, as shown in FIG. 1, forefoot portion 113 includes a plurality of peripheral forefoot chambers 114, 116, 118, 120 and a central forefoot air chamber 122. Preferably, the volume of air within the chambers of forefoot portion 113 is substantially the same as or slightly less than the volume of air within the chambers of heel portion 103.

As shown in FIG. 1, impedance means 126 and 128 are disposed within central connecting passage 124. Impedance means 126 and 128 provide a restriction in central connecting passage 124 to restrict the flow of air through central connecting passage 124. In one embodiment, impedance means 126 and 128 comprise a convolution of connecting passage 124 formed by restriction walls 129 (shown in detail in FIG. 4) placed in central connecting passage 124. In FIG. 1 impedance means 126 is shown as being substantially oval-shaped, and impedance means 128 is shown as being substantially circular. However, impedance means 126 and 128 may comprise numerous shapes or structures. For example, in another embodiment, the impedance means could be provided by a pinch-off of the material or increased wall thickness of the material.

Impedance means 126 and 128 prevent air from rushing out of heel chambers 104, 106, 108, 110 and 112 upon heel strike wherein pressure is increased in heel portion 103. The shape or structure of impedance means 126 and 128 determines the amount of air that is permitted to pass through central connecting passage 124 at any given time.

The different structures of the impedance means of the present invention are accomplished during the preferred blow-molding manufacturing process described above. Accordingly, no complicated or expensive valve means need be attached to resilient insert 102. Rather, the shape of impedance means 126 and 128 is determined by the same mold used to form the remainder of resilient insert 102.

As noted above, the shape of impedance means 126 and 128 will affect the rate and character of air flow within resilient insert 102, in particular between heel portion 103 and forefoot portion 113 thereof.

Central connecting passage 124 comprises an elongated passage which connects heel portion 103 to forefoot portion 113. Central connecting passage 124 has a first branch 130, connected to forefoot air chamber 114, a second branch 132, connected to central forefoot air chamber 122, and a third branch 134, connected to forefoot air chamber 118. These separate branches 130–134 allow air to flow directly into forefoot portion 113 via three separate chambers to distribute air to forefoot chambers 114, 116, 118, 120 and 122. Further, central connecting passage 124 is directly connected to heel air chamber 104 in heel portion 103.

In an alternate embodiment of resilient insert 102, heel portion 103 and forefoot portion 113 may each include only one air chamber. In this embodiment, central connecting passage 124 has only one branch to connect the heel chamber with the forefoot chamber. Similarly, it would be apparent to one skilled in the relevant art to alter the number of air chambers in heel portion 103 and forefoot portion 113 to accommodate different conditions and/or gait patterns. As such, the number of branches of central connecting passage 124 would also vary accordingly to distribute air to the chambers in forefoot portion 113.

Heel chambers 104, 106, 108, 110 and 112 are fluidly interconnected via periphery passages 136. Periphery passages 136 allow air to transfer between chambers 104, 106, 108, 110 and 112 in heel portion 103. Similarly, forefoot chambers 114 and 116 and forefoot chambers 118 and 120 are fluidly interconnected via periphery passages 136, as shown in FIG. 1. Periphery passages 136 in heel portion 103 essentially divide heel portion 103 into two regions: a medial region 140 and a lateral region 142. Medial region 140 includes heel chambers 108 and 110, while lateral region includes heel chambers 104, 106 and 112.

A sealed molding port 138 is disposed adjacent the rear of heel portion 103, indicating the area where a molding nozzle was positioned during blow molding. In an alternate embodiment, the molding nozzle can be positioned at the top of forefoot portion 113 for blow molding resilient insert 102. Port 138 may easily be removed (such as by cutting or shaving) during the manufacturing process.

As previously indicated, resilient insert 102 is formed of a suitably resilient material so as to enable heel and forefoot portions 103, 113 to compress and expand. Central connecting passage 124 is preferably formed of the same resilient material as the two oppositely-disposed portions adjacent its ends.

As shown in FIG. 2, heel chambers 104, 106, 108, 110 and 112 are slightly larger in volume, than forefoot chambers 114, 116, 118, 120 and 122. This configuration provides heel chambers 114, 116, 118, 120 and 122 with a larger volume of air for support and cushioning of the wearer's foot. Since typically during walking and running, the heel of the wearer receives a larger downward force during heel strike, than the forefoot receives during "toe-off", the extra volume of air in heel chambers 104, 106, 108, 110 and 112 provides the added support and cushioning necessary for the comfort of the wearer.

Figure 3:
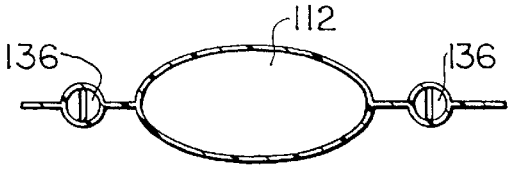
FIG. 3 is a cross-sectional view taken along line 3—3 of FIG. 1.

FIG. 3 is a cross-section view of resilient insert 102 taken along line 3—3 of FIG. 1. In particular, periphery passages 136 and central heel air chamber 112 are shown in FIG. 3. In one embodiment, central heel air chamber is triangular in shape, as opposed to the more oval shape of heel chambers 104, 106, 108, 110. Further, central heel air chamber 112 is slightly flatter than the remaining heel chambers 104, 106, 108, 110. This is because the center of the wearer's heel does not typically encounter as much of a downward force upon heel strike as the outer edges of the wearer's heel, and thus the center of the heel does not require as much cushioning and support.

Figure 4:
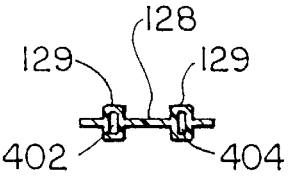
FIG. 4 is a cross-sectional view taken along line 4—4 of FIG. 1.

FIG. 4 is a cross-section view of resilient insert 102 taken along line 4—4 of FIG. 1. In particular, impedance means 128 is shown in FIG. 3. As shown, restriction walls 129 of impedance means 128 form barriers in central connecting passage 124. The sides of central connecting passage 124 and impedance means 128 combine to form narrow passages 402 and 404 on either side of impedance means 128. Narrow passages 402 and 404 slow the flow of air between heel portion 103 and forefoot portion 113 so that upon heel strike, the air in heel portion 103 gradually flows into forefoot portion 113 to provide adequate support and cushioning to the wearer's foot.

As shown in FIG. 1, once the air passes impedance means 128, it enters forefoot portion 113 via three branches 130, 132, 134. The air is then distributed via three branches 130, 132, 134 to forefoot chambers 114, 116, 118, 120 and 122.

Figure 5:
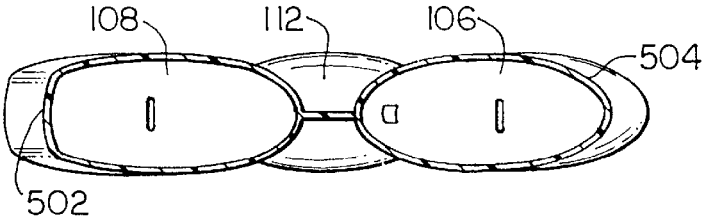
FIG. 5 is a cross-sectional view taken along line 5—5 of FIG. 1.

FIG. 5 shows a cross-sectional view of resilient insert 102 taken along line 5—5 of FIG. 1. In particular, FIG. 5 shows heel chambers 106 and 108. As shown, heel air chamber 108, disposed in medial region 140, has a squared edge 502. Similarly, heel air chamber 110 (not visible in FIG. 5) also has a squared edge. Squared edge 502 provides extra stiffness to heel chambers 108 and 110 so that these chambers are not compressed as easily during heel strike as the remaining heel chambers 104, 106 and 112. In particular, squared edges 502 provide added strength to the comers of chambers 108 and 110 so that they are harder to collapse during heel strike.

Heel chambers 108 and 110 thus provide added support to the wearer's foot in medial region 140 to address the problem of pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, and then moves to the medial side of the forefoot area during "toe-off." Heel chambers 108 and 110 on medial portion 140 address the problem of pronation by preventing the wearer's foot from rolling to the medial side during toe-off by providing the chambers on medial portion 140 with squared edge 502.

Heel air chamber 106, disposed in lateral region 142, has a rounded edge 504. Similarly, heel air chamber 104 (not visible in FIG. 5) also has a rounded edge. Rounded edge 504 allows heel chambers 104 and 106 to gradually collapse under pressure from the heel strike so that air from heel portion 103 begins to flow into central connecting passage 124 and forefoot portion 113. Because lateral portion 142 of heel portion 103 does not require as much support as medial portion 140, rounded edge 504 of heel chambers 104 and 106 provides adequate support to the wearer during heel strike.

Figures 6, 7:
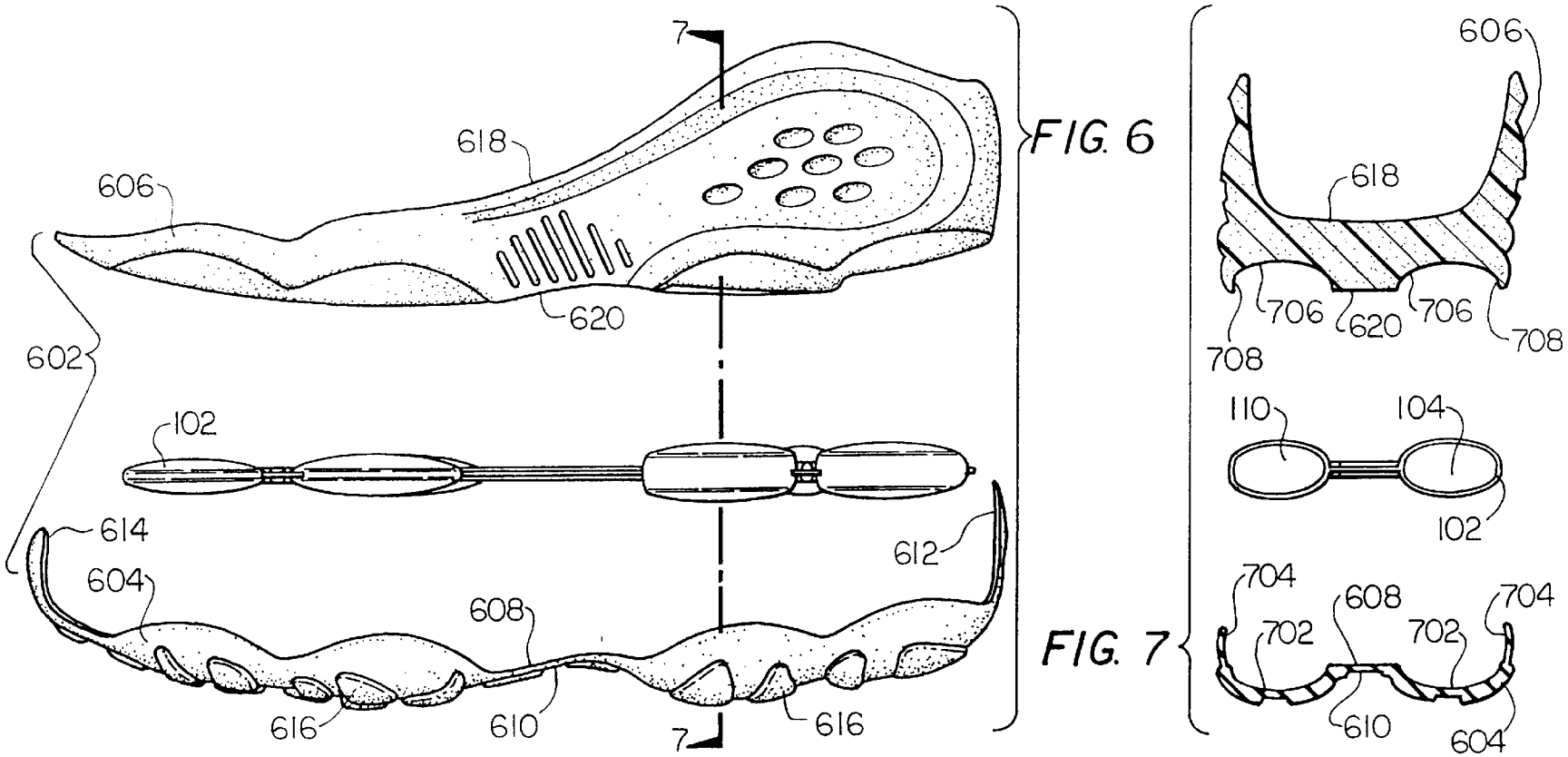
FIG. 6 is an exploded view of one possible interrelationship of an outsole, resilient insert and midsole in accordance with the present invention.
FIG. 7 is a cross-sectional view taken along line 7—7 of FIG. 6.

In order to appreciate the manner in which resilient insert 102 may be incorporated within a shoe, FIGS. 6 and 7 disclose one possible manner of incorporation. FIG. 6 is an exploded view showing resilient insert 102 disposed within a sole 602. FIG. 7 is a cross-sectional view of sole 602 taken along line 7—7 of FIG. 6. Sole 602 includes an outsole 604 and a midsole 606. Thus, in the embodiment shown in FIG. 6, resilient insert 102 is shown disposed between outsole 604 and midsole 606. Outsole 604 and midsole 606 are described below with reference to FIGS. 6–9.

Figure 8:
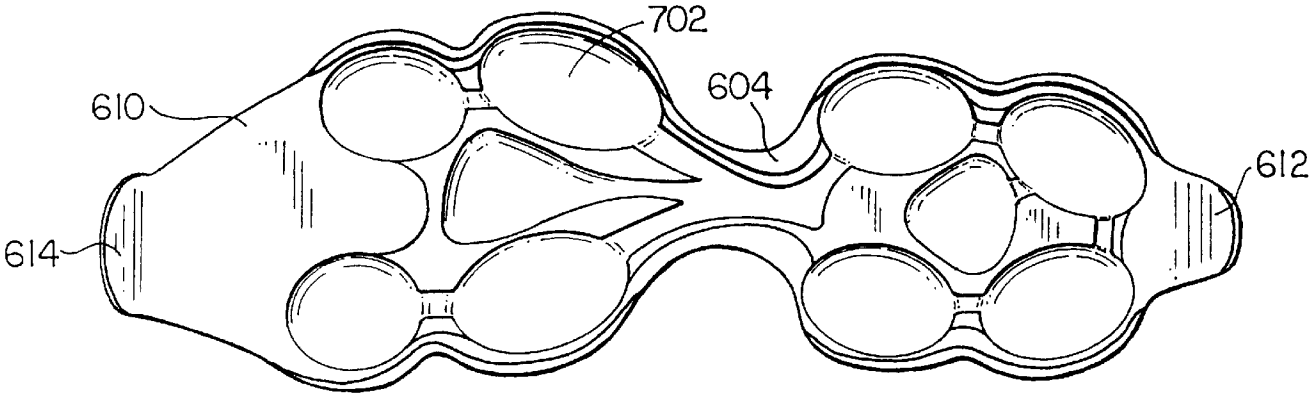
FIG. 8 is a bottom plan view of the outsole of the present invention, as shown in FIG. 6.

Outsole 604 has an upper surface 608 and a lower surface 610. Further, outsole 604 has a rear tab 612 and a front tab 614. As shown in FIG. 7, upper surface 608 has concave indentations 702 formed therein having upturned side edges 704. Indentations 702 are formed to receive resilient insert 102. Upturned side edges 704 cover the edges of resilient member 102 so that the exterior of resilient insert 102 is not physically exposed to the wearer's surroundings. Further, rear tab 612 and front tab 614 are attached to midsole 606 to prevent the front or rear of resilient insert 102 from being exposed. In one embodiment, outsole 604 is made from a clear crystalline rubber material so that resilient insert 102 is visible to the wearer through outsole 604. Outsole 604 has tread members 616 on lower surface 610. Further, as shown in FIG. 8, the bottom surface of concave indentations 702 on lower surface 610 of outsole 604 contact the ground during use.

Figure 9:
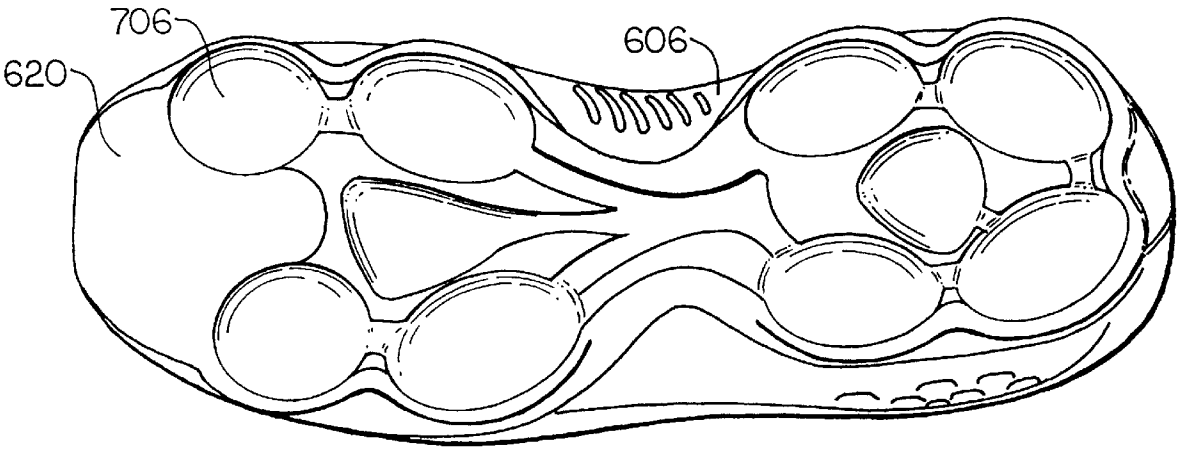
FIG. 9 is a bottom plan view of the midsole of the present invention, as shown in FIG. 6.

Midsole 606 has an upper surface 618 and a lower surface 620. As shown in FIGS. 7 and 9, lower surface 620 of midsole 606 has concave indentations 706 formed therein. Indentations 706 are formed to receive resilient insert 102. Midsole 606 also has side edges 708, as shown in FIG. 7. In one embodiment, midsole 606 is made from EVA foam, as is conventional in the art.

Although in the illustrated embodiment of FIG. 6 resilient insert 102 is disposed between outsole 604 and midsole 606, those skilled in the relevant art will appreciate that resilient insert 102 may alternatively be disposed within a cavity formed within midsole 606.

Figure 10:
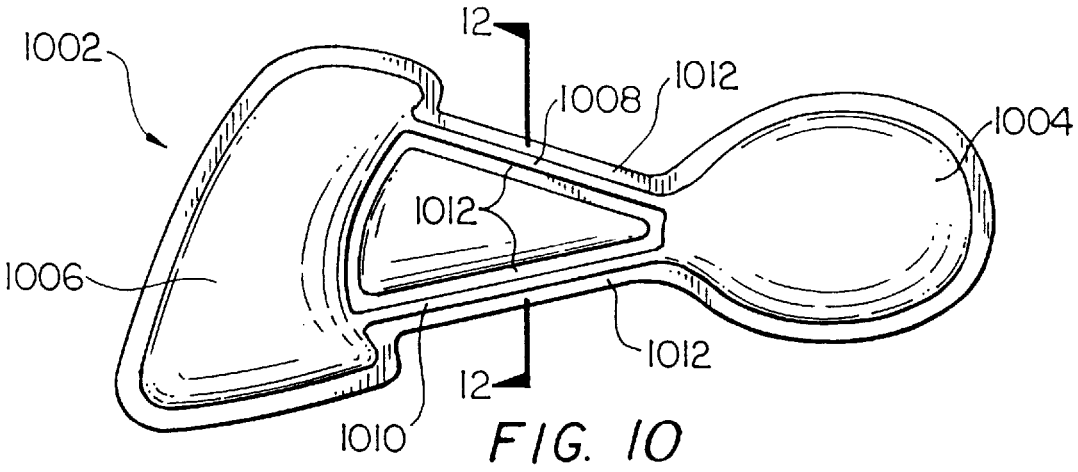
FIG. 10 is a top plan view of a bladder of the present invention.
Figure 11:
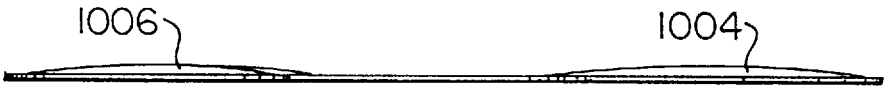
FIG. 11 is a medial side view of the bladder of FIG. 10.
Figure 12:
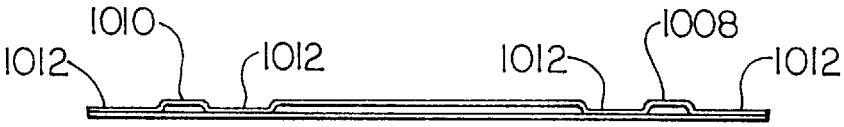
FIG. 12 is a cross-sectional view taken along line 12—12 of FIG. 10.

FIGS. 10–12 show a bladder 1002 of the present invention. Bladder 1002 has a rear air chamber 1004 and a front air chamber 1006. In one embodiment, bladder 1002 is manufactured by thermoforming two sheets of plastic film. Each sheet of film used in the thermoforming process is between approximately 6–25 mils (0.15–0.60 mm). In the preferred embodiment, sheets of film between 10–15 mils (0.25–0.40 mm) are preferred. FIG. 10 shows weld lines 1012 created by the thermoforming manufacturing process. Bladder 1002 is made from a relatively soft material, such as urethane film having a hardness of Shore A 80–90, so that bladder 1002 provides added cushioning to the wearer.

During the thermoforming process, weld lines 1012 form connecting passages 1008 and 1010 which fluidly connect rear and front chambers 1004 and 1006. Connecting passages 1008 and 1010 are preferably narrow, approximately 0.030 inch (0.8 mm)–0.050 inch (1.3 mm) in width and 0.030 inch (0.8 mm)–0.050 inch (1.3 mm) in height, to control the rate of air flow between rear air chamber 1004 and front air chamber 1006 during use. In another embodiment, bladder 1002 may be formed by RF welding, heat welding or ultrasonic welding of the urethane film material, instead of thermoforming.

Bladder 1002 is a hollow structure preferably filled with air at slightly above ambient pressure (e.g., at 1–5 psi above ambient pressure). In one embodiment, bladder 1002 is impermeable to air; i.e., hermetically sealed, such that it is not possible for the air disposed therein to escape upon application of force to bladder 1002. Naturally, diffusion may occur in and out of bladder 1002. However, because bladder 1002 contains air at only slightly above ambient pressure, it retains its cushioning properties throughout the life of the article of footwear in which it is incorporated.

FIG. 11 shows a medial side view of bladder 1002. As shown in FIGS. 11 and 12, the portion of bladder 1002 disposed between connecting passages 1008 and 1010, is relatively flat. Thus, bladder 1002 provides cushioning for the heel and forefoot portions of the wearer's feet. FIG. 12 shows a cross-sectional view of bladder 1002 taken along line 12—12 of FIG. 10. In particular, FIG. 12 shows connecting passages 1008 and 1010 formed by weld lines 1012.

Figures 13, 14:
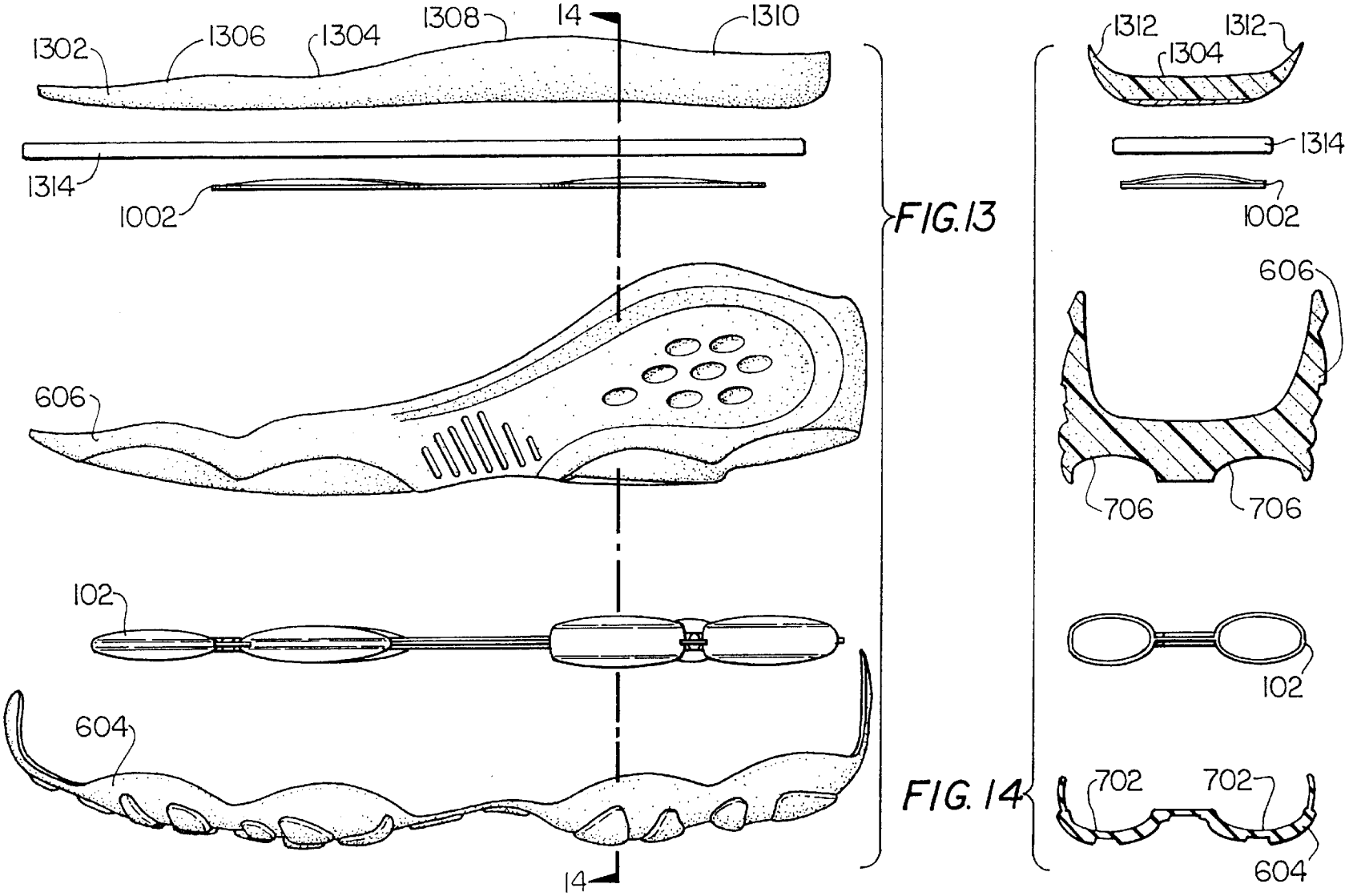
FIG. 13 is an exploded view of an alternate interrelationship of the outsole, resilient insert, midsole and bladder in accordance with the present invention.
FIG. 14 is a cross-sectional view taken along line 14—14 of FIG. 13.

In order to appreciate the manner in which resilient insert 102 and bladder 1002 may cooperate to provide both support and cushioning within a shoe, FIGS. 13 and 14 disclose one possible manner of incorporation of these members within the shoe. FIG. 13 is an exploded view showing resilient insert 102 and bladder 1002 as disposed within a shoe. FIG. 14 is a cross-sectional view of the shoe taken along line 14—14 of FIG. 13. Thus, in the embodiment shown in FIG. 13, resilient insert 102 is shown disposed between outsole 604 and midsole 606. FIG. 14 shows the indentations formed in outsole 604 and midsole 606 to accommodate resilient insert 102, as described above.

Bladder 1002 is shown disposed above midsole 606 and below a lasting board 1314 and a sockliner 1302. Lasting board 1314 may be made from a thick paper material, fibers or textiles, and is disposed between sockliner 1302 and bladder 1002. Sockliner 1302 includes a foot supporting surface 1304 having a forefoot region 1306, an arch support region 1308 and a heel region 1310. A peripheral wall 1312 extends upwardly from and surrounds a portion of foot supporting surface 1304.

Disposed on the underside of sockliner 1302 is a moderating surface made from a stiff material comprising moderator 1402 (shown in FIG. 14). Moderator 1402 acts as a stiff "plate" between bladder 1002 and the foot of a wearer. Preferably, moderator 1402 is formed of material having a hardness of Shore A 75–95 or Shore C 55–75. Potential materials used to form moderator 1402 include EVA, PU, polypropylene, polyethylene, PVC, PFT, fiberboard and other thermoplastics which fall within the aforementioned hardness range. The relatively stiff material acts as a moderator for foot strike and diffuses impact forces evenly upon bladder 1002 and resilient insert 102, thereby reducing localized pressures.

In an alternate embodiment, instead of making moderator 1402 out of a separate material, lasting board 1314 could act as a moderator. In another embodiment, sockliner 1302 may serve as a moderator. In still another embodiment, moderator 1402 may be made from a combination of sockliner 1302, lasting board 1314 and/or one or more of the materials described above having a sufficient hardness to act as a moderator. Thus, it will be appreciated by those skilled in the art that moderator may comprise any structure that accomplishes the above-mentioned moderating function, including part of a midsole, outsole, insole, or a combination of these elements.

Figure 15:
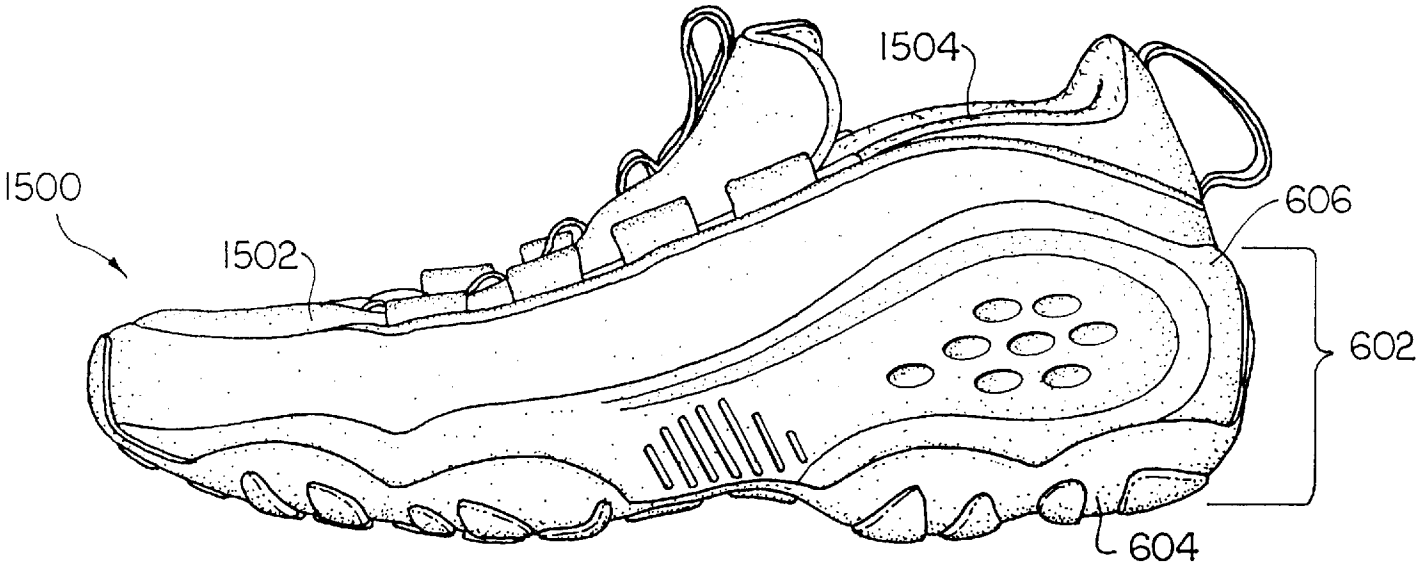
FIG. 15 is a perspective view of a shoe of the present invention.

An article of footwear incorporating the present invention is now described. Resilient insert 102 and bladder 1002 are disposed within an article of footwear 1500, shown in FIG. 15. Article of footwear 1500 includes a sole 602 including outsole 604 and midsole 606. Resilient insert 102 is disposed between outsole 604 and midsole 606. Although resilient insert 102 is not visible in FIG. 15, in the preferred embodiment, outsole 604 is made from a clear rubber material so that resilient insert 102 is visible. Further, bladder 1002 (not visible in FIG. 15) is disposed between midsole 606 and lasting board 1302 (not visible in FIG. 15).

An upper 1502 is attached to sole 602. Upper 1502 has an interior portion 1504. The insole is disposed in interior portion 1504.

In order to fully appreciate the cushioning effect of the present invention, the operation of the present invention will now be described in detail. When stationary, the foot of a wearer is cushioned by bladder 1002. Although the maximum thickness of bladder 1002, is approximately 0.2 inch (5 mm) above the top surface of midsole 606, the bladder produces an unexpectedly high cushioning effect. In one embodiment, bladder 1002, made by RF welding, is between 0.08–0.12 inch (2–3 mm). If bladder 1002 is blow molded, it may be as thick as 0.28–0.31 inch (7–8 mm) when manufactured, and is partially recessed in midsole 606.

When the wearer begins a stride, the heel of the wearer's foot typically impacts the ground first. At this time, the weight of the wearer applies downward pressure on heel portion 103 of resilient insert 102, causing heel chambers 104, 106, 108, 110 and 112 of heel portion 103 to be forced downwardly.

The configuration of periphery passages 136 between heel chambers 104–112 can help compensate for the problem of pronation, the natural tendency of the foot to roll inwardly after heel impact. During a typical gait cycle, the main distribution of forces on the foot begins adjacent the lateral side of the heel during the "heel strike" phase of the gait, then moves toward the center axis of the foot in the arch area, and then moves to the medial side of the forefoot area during "toe-off." The configuration of heel chambers 104, 106, 108, 110 and 112 is incorporated within resilient insert 102 to ensure that the air flow within resilient insert 102 complements such a gait cycle.

Referring to FIG. 1, it has been previously noted that periphery passages 136 within heel portion 103 essentially divide heel portion 103 into two regions: medial region 140 and lateral region 142. The downward pressure resulting from heel strike causes air within resilient insert 102 to flow from medial region 140, including heel chambers 108 and 110, into lateral region 142, including heel chambers 104, 106 and 112. Thus, medial region 142, is cushioned first to prevent the wearer's foot from rolling inwardly. Further compression of heel portion 103 causes the air in lateral region 142 to be forced forwardly, through central connecting passage 124, into forefoot portion 113.

The velocity at which the air flows between heel chambers 104, 106, 108, 110 and 112 and forefoot chambers 114, 116, 118, 120 and 122 depends on the structure of central connecting passage 124 and, in particular, the structure of impedance means 126 and 128.

The flow of air into forefoot portion 113 causes forefoot chambers 114, 116, 118, 120 and 122 to expand, which slightly raises the forefoot or metatarsal area of the foot. It should be noted that when forefoot chambers 114, 116, 118, 120 and 122 expand, they assume a somewhat convex shape. When the forefoot of the wearer is placed upon the ground, the expanded forefoot chambers 114, 116, 118, 120 and 122 help cushion the corresponding impact forces. As the weight of the wearer is applied to the forefoot, the downward pressure caused by the impact forces causes forefoot chambers 114, 116, 118, 120 and 122 to compress, forcing the air therein to be thrust rearwardly through connecting passage 124 into heel portion 103. Once again, the velocity at which the air flows from forefoot chambers 114, 116, 118, 120 and 122 to heel chambers 104, 106, 108, 110 and 112 will be determined by the structure of impedance means 126 and 128.

After "toe-off," no downward pressure is being applied to the article of footwear, so the air within resilient insert 102 should return to its normal state. Upon the next heel strike, the process is repeated.

In light of the foregoing, it will be understood that resilient insert 102 of the present invention provides a variable, non-static cushioning, in that the flow of air within resilient insert 102 complements the natural biodynamics of an individual's gait.

Because the "heel strike" phase of a stride or gait usually causes greater impact forces than the "toe-off" phase thereof, it is anticipated that the air will flow more quickly from heel portion 103 to forefoot portion 113 than from forefoot portion 113 to heel portion 103. Similarly, impact forces are usually greater during running than walking. Therefore, it is anticipated that the air flow will be more rapid between the chambers during running than during walking.

The foregoing description of the preferred embodiment has been presented for purposes of illustration and description. It is not intended to be exhaustive or to limit the invention to the precise form disclosed, and obviously many modifications and variations are possible in light of the above teachings. For example, it is not necessary that resilient insert 102, especially heel portion 103, forefoot portion 113 and connecting passage 124 thereof, be shaped as shown in the figures. Chambers of other shapes may function equally as well.

Figure 18:
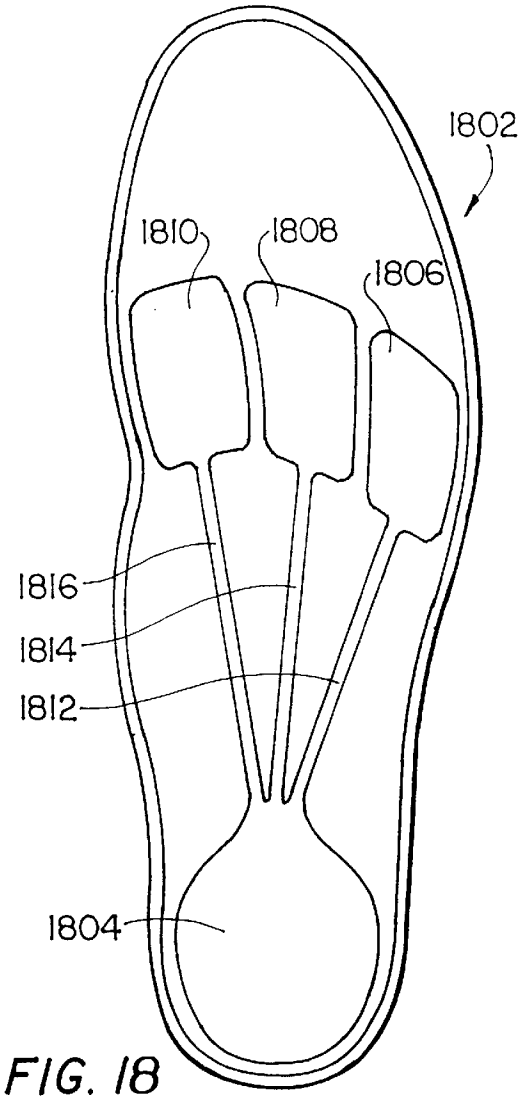
FIGS. 16–18 show alternate embodiments of bladders of the present invention.
Figure 17:
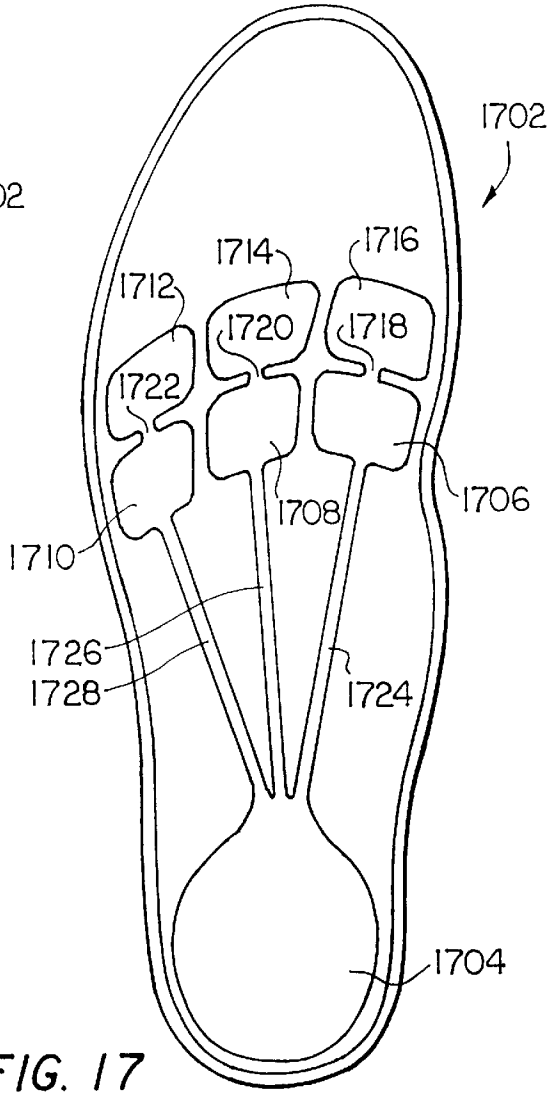
Figure 16:
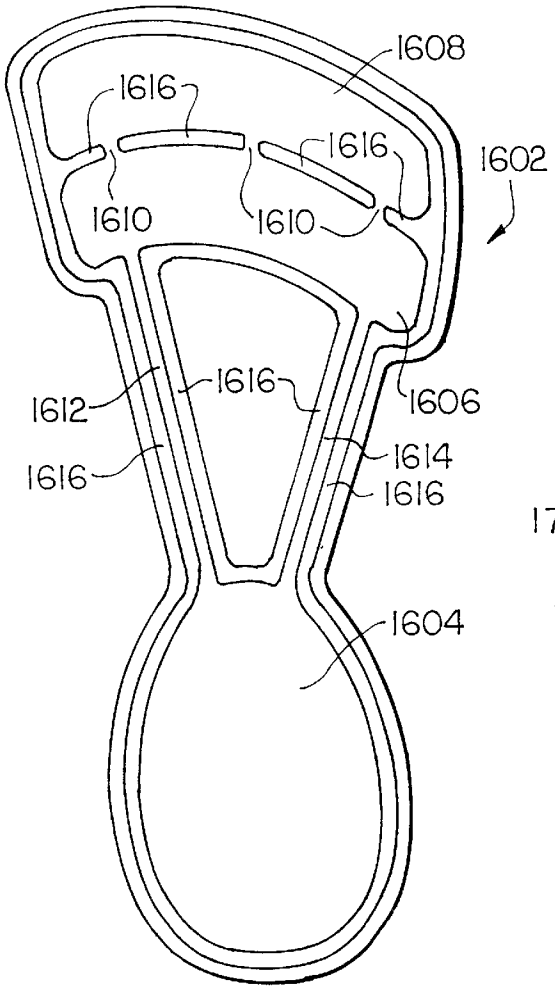

Similarly, it is not necessary that bladder 1002 be shaped as shown in FIG. 10. For example, FIGS. 16–18 show alternate embodiments of the bladder of the present invention. All three of these bladders are formed by thermoforming, as described above with respect to bladder 1002, and contain air at slightly above ambient pressure.

FIG. 16 shows a second embodiment of a bladder 1602 of the present invention. Bladder 1602 has a rear chamber 1604, a first front chamber 1606 and a second front chamber 1608. First and second front chambers 1606 and 1608 are connected via small passages 1610 formed by weld lines 1616. Bladder 1602 has connecting passages 1612 and 1614 formed by weld lines 1616, identical to bladder 1002. Connecting passages 1612 and 1614 connect rear chamber 1604 and first front chamber 1606.

FIG. 17 shows a third embodiment of a bladder 1702 of the present invention. Bladder 1702 has a rear chamber 1704 and a plurality of front chambers 1706, 1708, 1710, 1712, 1714 and 1716. Front chamber 1706 and 1716 are connected via a small passage 1718. Similarly, front chambers 1708 and 1714 are connected via a small passage 1720 and front chambers 1710 and 1712 are connected via a small passage 1722. Bladder 1702 has connecting passages 1724, 1726 and 1728. Connecting passage 1724 connects rear chamber 1704 and front chamber 1706. Similarly, connecting passage 1726 connects rear chamber 1704 and front chamber 1708, and connecting passage 1728 connects rear chamber 1704 and front chamber 1710.

FIG. 18 shows a fourth embodiment of a bladder 1802 of the present invention. Bladder 1802 has a rear chamber 1804 and a plurality of front chambers 1806, 1808 and 1810. Bladder 1802 has connecting passages 1812, 1814 and 1816. Connecting passage 1812 connects rear chamber 1804 and front chamber 1806. Similarly, connecting passage 1814 connects rear chamber 1804 and front chamber 1808, and connecting passage 1816 connects rear chamber 1804 and front chamber 1810.

With reference to FIGS. 1 and 5, it will be appreciated that resilient insert 102 comprises an insert which may be positioned within different areas of an article of footwear. Accordingly, although resilient insert 102 is shown as being positioned between outsole 604 and midsole 606 in FIG. 6, it is to be understood that resilient insert 102 may also be positioned within a cavity formed within a midsole or between a midsole and an insole. When positioned between a midsole and an outsole, resilient insert 102 may be visible from the exterior of the shoe. Further, it will be appreciated that the shoe in which resilient insert 102 is incorporated may be constructed so that resilient insert 102 is readily removable and may easily be replaced with another resilient insert. Accordingly, different resilient inserts can be inserted depending upon the physical characteristics of the individual and/or the type of activity for which the shoe is intended.

In addition to the above-noted changes, it will be readily appreciated that the number of chambers, the number or location of connecting passages 124, and/or the location of periphery passages 136 of resilient insert 102 may also be varied. For example, the chambers of resilient insert 102 may be divided such that resilient insert 102 has two cushioning systems which function independently of one another. In the preferred embodiment of FIG. 1, resilient insert 102 provides "multistage" cushioning, wherein the different chambers compress in sequence through the gait cycle.

An alternative embodiment would include valve means disposed adjacent connecting passage 124, in order to allow the flow rate to be adjusted. Another embodiment, would be to provide resilient insert 102 with at least two connecting passages 124 with each passage including an interior check-valve. The check valves could simply comprise clamping means formed within connecting passages 124. In such a construction, each connecting passage 124 would have a check valve to form a one-way passage such that air could only flow in one direction therethrough. An example of such a valve is provided in U.S. Pat. No. 5,144,708, which describes therein a one-way valve commonly referred to as a Whoopie valve, available from Dielectric, Industries, Chicopee, Mass. In one example, fluid may flow from heel portion 103 to forefoot portion 113 through a first connecting passage, and from forefoot portion 113 to heel portion 103 via a second connecting passage. The air flow in this embodiment could thus be directed such that it mimics the typical gait cycle discussed above. Further, one of the connecting passages could include impedance means which provides laminar air flow, while the other communication chamber could include impedance means to provide turbulent air flow.

Although two differently-shaped impedance means are shown in the accompanying drawings, other shapes will also serve to provide support and cushioning to resilient insert 102 of the present invention. The shape of impedance means 126 and 128 will directly affect the velocity of the air as it travels within resilient insert 102.

The mass flowrate of air within the resilient insert of the present invention is dependent upon the velocity of the heel strike (in the case of air traveling from the heel chamber to the forefoot chamber). Further, the size and structure of the impedance means of the present invention directly affects the impulse forces exerted by the air moving within the chambers of the resilient insert. With a given flowrate, the size and structure of the impedance means will dramatically affect the velocity of the air as it travels through the impedance means. Specifically, as the cross-sectional area of the impedance means becomes smaller, the velocity of the air flow becomes greater, as do the impulse forces felt in the forefoot and heel chambers.

As discussed herein, in one embodiment of the present invention, ambient air is disposed within resilient insert 102. However, in an alternate embodiment of the present invention, pressurized air may be disposed within resilient insert 102. For example, in order to keep forefoot and heel portions 113, 103 slightly convex, a slight pressure (approximately 1–4 psi above ambient pressure) may be introduced into resilient insert 102 when sealing the member closed. Further, it will be appreciated that other fluid mediums, including liquids and large molecule gases, may be disposed within resilient insert 102 and provide the desired support and cushioning thereto. If a fluid medium other than ambient air is used, the structure of the impedance means may be modified in order to effectively provide the character of fluid flow desired.

It is anticipated that the Preferred embodiment of resilient insert 102 of the present invention will find its greatest utility in athletic shoes (i.e., those designed for walking, hiking, running, and other athletic activities).

While the invention has been particularly shown and described with reference to preferred embodiments thereof, it will be understood by those skilled in the art that various changes in form and details may be made therein without departing from the spirit and scope of the invention.

What is claimed is:

1. An article of footwear comprising:

a sole;

a resilient insert disposed within said sole, said resilient insert including a plurality of first chambers fluidly interconnected to each other, a plurality of second chambers fluidly interconnected to each other, and a connecting passage connecting said plurality of first chambers and said plurality of second chambers; and a flexible bladder disposed above said resilient insert and beneath a wearer's foot.

2. The article of footwear of claim 1, wherein said flexible bladder contains air at slightly above ambient pressure, and wherein said flexible bladder comprises a first chamber, a second chamber, and a connecting passage fluidly connecting said first and second chambers.

3. The article of footwear of claim 1, wherein said resilient insert contains air at ambient pressure.

4. The article of footwear of claim 1, wherein said resilient insert contains air at slightly above ambient pressure.

5. The article of footwear of claim 1, wherein said resilient insert further comprises impedance means, disposed within said connecting passage, for restricting a flow of air between said plurality of first chambers and said plurality of second chambers, wherein a cross-sectional area of said connecting passage, taken at a point at which said impedance means is disposed, has an average cross-sectional area less than the remainder of said connecting passage.

6. The article of footwear of claim 1, wherein said sole further comprises an outsole and a midsole, and wherein said resilient insert is disposed between said outsole and said midsole.

7. The article of footwear of claim 6, wherein said outsole further comprises an upper surface and a lower surface, said upper surface of said outsole having a plurality of concave indentations therein for receiving said plurality of first and second chambers of said resilient insert.

8. The article of footwear of claim 6, wherein said midsole further comprises an upper surface and a lower surface, said lower surface of said midsole having a plurality of concave indentations therein for receiving said plurality of first and second chambers of said resilient insert.

9. The article of footwear of claim 1, wherein said resilient insert is formed of a blow-molded elastomeric material.

10. The article of footwear of claim 1, wherein said flexible bladder comprises two sheets of a resilient, non-permeable material which have been dielectrically welded to form said first and second chambers and said connecting passage of said flexible bladder.

11. The article of footwear of claim 1, further comprising a moderator, wherein said flexible bladder is disposed between said midsole and said moderator.

12. An article of footwear comprising:

a sole; and a resilient insert containing air at ambient pressure disposed within said sole, said resilient insert including a plurality of heel chambers fluidly interconnected to each other, a plurality of forefoot chambers fluidly interconnected to each other, and a connecting passage connecting said plurality of heel chambers and said plurality of forefoot chambers, wherein said connecting passage is directly fluidly interconnected to only one heel chamber of said plurality of heel chambers.

13. The article of footwear of claim 12, further comprising impedance means, disposed within said connecting passage, for restricting a flow of air between said plurality of heel chambers and said plurality of forefoot chambers.

14. The article of footwear of claim 12, wherein said sole further comprises an outsole and a midsole, and wherein said resilient insert is disposed between said outsole and said midsole.

15. The article of footwear of claim 14, wherein said outsole further comprises an upper surface and a lower surface, said upper surface of said outsole having a plurality of concave indentations therein for receiving said plurality of heel and forefoot chambers of said resilient insert.

16. The article of footwear of claim 14, wherein said midsole further comprises an upper surface and a lower surface, said lower surface of said midsole having a plurality of concave indentations therein for receiving said plurality of heel and forefoot chambers of said resilient insert.

17. The article of footwear of claim 12, wherein said resilient insert is formed of a blow-molded elastomeric material.

18. An article of footwear comprising:

a midsole;

an outsole disposed below said midsole;

a resilient insert disposed between said midsole and said outsole, said resilient insert including a first air chamber, a second air chamber, and a connecting passage connecting said first air chamber and said second air chamber; and a flexible bladder disposed above said midsole and beneath a wearer's foot.

19. The article of footwear of claim 18, said flexible bladder including a first chamber, a second chamber, and a connecting passage connecting said first and second chambers.

20. The article of footwear of claim 18, wherein said resilient insert further comprises impedance means, disposed within said connecting passage of said resilient insert, for restricting a flow of air between said plurality of first chambers and said plurality of air second chambers, wherein a cross-sectional area of said connecting passage of said resilient insert, taken at a point at which said impedance means is disposed, has an average cross-sectional area less than the remainder of said connecting passage.

21. The article of footwear of claim 18, wherein said outsole further comprises an upper surface and a lower surface, said upper surface of said outsole having a plurality of concave indentations therein for receiving said plurality of first and second chambers of said resilient insert.

22. The article of footwear of claim 18, wherein said midsole further comprises an upper surface and a lower surface, said lower surface of said midsole having a plurality of concave indentations therein for receiving said plurality of first and second chambers of said resilient insert.

23. The article of footwear of claim 18, wherein said resilient insert is formed of a blow-molded elastomeric material.

24. The article of footwear of claim 18, wherein said flexible bladder comprises two sheets of a resilient, non-permeable material which have been welded to form said first and second chambers and said connecting passage of said flexible bladder.

25. The article of footwear of claim 18, further comprising a moderator disposed above said midsole, wherein said flexible bladder is disposed between said midsole and said moderator.

26. A resilient insert for an article of footwear comprising:

a plurality of resilient, non-permeable, heel chambers containing air at ambient pressure, said plurality of heel chambers fluidly interconnected to each other;

a resilient, non-permeable, forefoot chamber containing air at ambient pressure; and a non-permeable connecting passage connecting said plurality of heel chambers and said forefoot chamber, wherein said connecting passage is directly fluidly interconnected to only one heel chamber of said plurality of heel chambers.

27. The resilient insert of claim 26, further comprising impedance means disposed within said connecting passage, wherein said impedance means restricts a flow of air between said plurality of heel chambers and said forefoot chamber and provides enhanced support and cushioning to the article of footwear by controlling the velocity at which the air moves between said plurality of heel chambers and said forefoot chamber.

28. The resilient insert of claim 26, wherein said resilient insert is formed of a unitary piece of blow-molded elastomeric material.

* * * * *